US007168487B2

(12) United States Patent
Salamitou et al.

(10) Patent No.: US 7,168,487 B2
(45) Date of Patent: Jan. 30, 2007

(54) METHODS, APPARATUS, AND SYSTEMS FOR OBTAINING FORMATION INFORMATION UTILIZING SENSORS ATTACHED TO A CASING IN A WELLBORE

(75) Inventors: Philippe Salamitou, Mamaroneck, NY (US); Jacques Jundt, Bethel, CT (US); Robert Bailey, Danbury, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 90 days.

(21) Appl. No.: 10/740,211

(22) Filed: Dec. 18, 2003

(65) Prior Publication Data

US 2004/0238166 A1 Dec. 2, 2004

Related U.S. Application Data

(63) Continuation-in-part of application No. 10/452,447, filed on Jun. 2, 2003.

(51) Int. Cl.
*E21B 47/01* (2006.01)

(52) U.S. Cl. ..... 166/250.11; 166/250.07; 166/254.1; 166/255.1; 175/48; 175/50

(58) Field of Classification Search ..... None
See application file for complete search history.

(56) References Cited

U.S. PATENT DOCUMENTS

| | | | | |
|---|---|---|---|---|
| 6,028,534 | A | 2/2000 | Ciglenec et al. | 340/856.2 |
| 6,070,662 | A | 6/2000 | Ciglenec et al. | 166/254.1 |
| 6,234,257 | B1 | 5/2001 | Ciglenec et al. | 175/50 |
| 6,378,610 | B2 | 4/2002 | Rayssiguier et al. | 166/281 |
| 6,426,917 | B1 | 7/2002 | Tabanou et al. | 367/82 |
| 6,443,228 | B1 | 9/2002 | Aronstam et al. | 166/250.11 |
| 6,538,576 | B1 | 3/2003 | Schultz et al. | 340/859.6 |
| 6,684,952 | B2 | 2/2004 | Brockman et al. | 166/250.03 |
| 6,691,779 | B1 | 2/2004 | Sezginer et al. | 166/250.01 |
| 6,693,553 | B1 | 2/2004 | Ciglenec et al. | 166/250.11 |
| 2001/0035288 | A1 | 11/2001 | Brockman et al. | 166/65.1 |
| 2002/0195247 | A1 | 12/2002 | Ciglenec et al. | 166/250.11 |
| 2003/0029611 | A1* | 2/2003 | Owens | 166/250.03 |

* cited by examiner

*Primary Examiner*—Zakiya W. Bates
(74) *Attorney, Agent, or Firm*—David P. Gordon; Jody Lynn DeStefanis; Dale Gaudier

(57) ABSTRACT

Methods, apparatus, and systems for obtaining information regarding a formation, a casing, or fluid within the casing are provided which utilize an interrogator and one or more sensing devices attached to a casing in a wellbore. The interrogator is located within and may be movable inside the wellbore. The sensing device is positioned and fixed in an opening in the casing. The sensing device includes a housing and a sensor with associated electronic circuitry. The interrogator and sensing device include a magnetic coupling therebetween that is operable when the interrogator and sensing device are positioned in close proximity to one another. Preferably, the magnetic coupling is realized by at least one solenoid winding for the interrogator and at least one solenoid winding for the sensing device, which provide a loosely-coupled transformer interface therebetween. The interrogator and sensing device communicate in a wireless manner over the magnetic coupling therebetween.

51 Claims, 4 Drawing Sheets

METHODS, APPARATUS, AND SYSTEMS FOR OBTAINING FORMATION INFORMATION UTILIZING SENSORS ATTACHED TO A CASING IN A WELLBORE

This application is a continuation-in-part of co-owned U.S. Ser. No. 10/452,447, entitled "Methods, Apparatus, and Systems for Obtaining Formation Information Utilizing Sensors Attached to a Casing in a Wellbore," filed on Jun. 2, 2003, and is also related to co-owned U.S. Ser. No. 10/163,784 to R. Ciglenec, et al. entitled "Well-Bore Sensor Apparatus and Method", and to co-owned U.S. Ser. No. 09/428,936 to A. Sezginer, et al. entitled "Wellbore Antennae System and Method", and to co-owned U.S. Pat. No. 6,426,917 and to co-owned U.S. Ser. No. 09/382,534 to R. Ciglenec et al. entitled "Reservoir Management System and Method", and to co-owned U.S. Pat. No. 6,028,534, and to co-owned U.S. Pat. No. 6,070,662, and to co-owned U.S. Pat. No. 6,234,257, and to U.S. Pat. No. 6,070,662, all of which are hereby incorporated by reference herein in their entireties.

BACKGROUND OF THE INVENTION

1. Field of the Invention

The present invention relates to methods, apparatus, and systems for obtaining information regarding a geological formation or a well passing through a geological formation. The present invention more particularly relates to methods, apparatus, and systems for exchanging information and power between an interrogating tool located in a cased borehole and sensors attached to the casing.

2. State of the Art

The extraction of oil and natural gas from a geological formation is usually accomplished by drilling boreholes through the subsurface formations in order to reach hydrocarbon-bearing zones, and then using production techniques for bringing the hydrocarbon to the surface through the drilled boreholes. To prevent the boreholes from collapsing, boreholes are often equipped with steel tubes called casings or liners which are cemented to the borehole wall. Once they are put in place, casings and liners preclude direct access to the formation, and therefore impede or prevent the measurement of important properties of the formation, such as fluid pressure and resistivity. For this reason, the logging of wellbores is routinely performed before the casing is set in place.

In order to optimize the depletion of the reservoir, it is highly desirable to monitor the temperature, pressure, and other formation parameters at different depths in the well, on a permanent basis, over most of the life of the well. Valuable information regarding the integrity of the wellbore can be gained from continuously monitoring parameters such as well inclination and casing thickness. A common approach to such monitoring consists of attaching sensors to the outside of the casing, interconnecting the sensors via cables to provide telemetry and power from the formation surface, and cementing the sensors and cables in place. A description of such a system is provided in U.S. Pat. No. 6,378,610 to Rayssiguier et al. Such a system has numerous apparent drawbacks such as complicating the installation of the casing and the impossibility of replacing failed components. Another monitoring system is disclosed in U.S. Patent Application 2001/0035288 to Brockman et al. which discloses means for exchanging information and power through the casing wall via inductive couplers. These couplers, however, require extensive modification of the casing and are not suitable for an installation in situ. In previously incorporated U.S. Pat. No. 6,070,662 to Ciglenec et al., means are disclosed for communicating with a sensor implanted in the formation, but this arrangement requires that the sensor be put in place prior to the installation of the casing. U.S. Pat. No. 6,443,228 to Aronstam et al. describes means of exchanging information and power between devices in the borehole fluid and devices implanted in the wellbore wall, but does not consider the problems introduced by the presence of a casing or a liner.

SUMMARY OF THE INVENTION

It is therefore an object of the invention to provide apparatus, methods, and systems for obtaining information regarding a geological formation or a well passing through a geologic formation.

It is another object of the invention to provide methods, apparatus, and systems for exchanging information and power between an interrogating tool located in a cased borehole and sensors attached to the casing.

It is a further object of the invention to provide apparatus, methods, and systems for communicating information between an interrogating tool in a borehole and a sensor attached to a casing without using cables and without significantly altering the casing.

In accord with the objects of the invention an interrogating device and a sensing device are provided. The sensing device (which is either installed on the outer surface of the casing or liner prior to installation of the casing in the borehole, or inserted into an opening cut in the casing after the casing is cemented in place) includes a housing and a sensor with associated electronic circuitry. The interrogating device is located within (and may be movable inside) the wellbore. The sensing device and the interrogator include a magnetic coupling therebetween that is operable when the sensing device and interrogator are positioned in close proximity to one another. Preferably, the magnetic coupling is realized by at least one solenoid winding for the interrogator (whose main axis is substantially parallel to the axis of the wellbore) and at least one solenoid winding for the sensing device (whose main axis is substantially parallel to the axis of the wellbore), to thereby provide a loosely-coupled transformer interface therebetween. The interrogator and sensing device communicate in a wireless manner over the magnetic coupling therebetween.

In a preferred embodiment of the present invention, when the interrogating device is placed in close proximity to the sensing device, an alternating current is circulated in the winding of the interrogating device to produce magnetic flux in the local region of the wellbore that is adjacent the interrogating device and sensing device. Part of this flux is collected by the sensor's winding, causing current to flow through the sensor winding. The current flowing through the sensor winding induces a voltage signal across a load impedance. By modulating the current circulating in the winding of the interrogating tool, information can be passed from the interrogating tool to the sensor device. Likewise, by modulating the load impedance of the winding of the sensor device (or by modulating the current circulating in the winding of the sensing device), information can be passed from the sensor device to the interrogating tool.

The system of the invention may include a plurality of sensing devices located along the length of the casing, and at least one interrogating device which is moved through the wellbore. The method of the invention may include locating a plurality of sensing devices along the length of the casing, moving the interrogating device with respect to the casing, using the interrogating device to signal the sensing device, and having the sensing device obtain information regarding the formation and provide that information to the interrogating device in a wireless manner.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
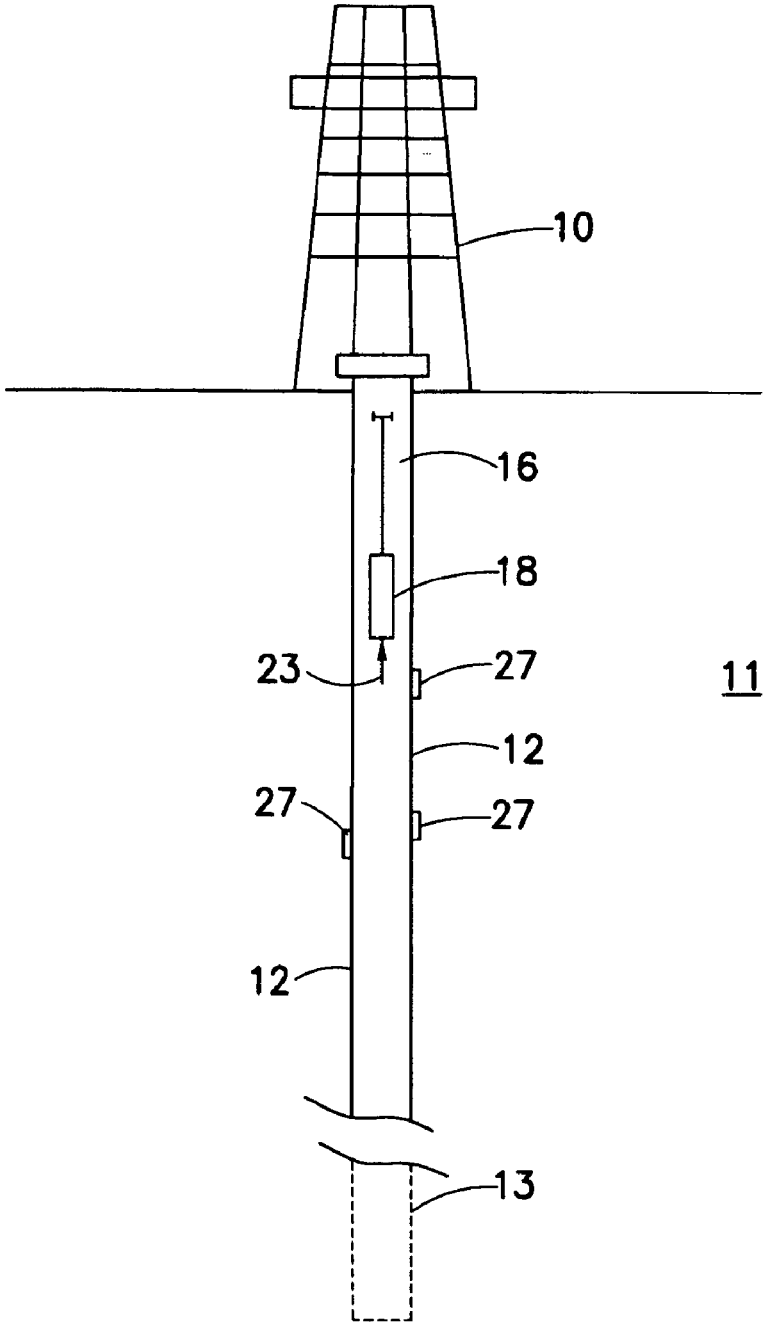
FIG. 1 is a schematic diagram showing an embodiment of the system of the invention in a wellbore of a formation.

Turning to FIG. 1, a highly schematic drawing of a typical oil production facility is seen. A rig 10 is shown atop an earth formation 11. The earth formation is traversed by a wellbore 13 having a casing 12 extending at least partially therein. The casing 12 contains a fluid 16 which is typically a conductive borehole fluid. Extending from the rig 10 or from a winch (not shown) into the casing is a tool 18.

One embodiment of the system of the invention 20 is shown in FIG. 1 as including an interrogator or interrogating device 23 which is coupled to or part of tool 18, and a sensing device 27. The interrogator 23 is movable inside the casing 12 of the wellbore, whereas the sensing device 27 is typically fixed in the casing 12 as described below. According to the invention, the system of the invention 20 includes at least one interrogator 23 and at least one sensing device 27. In certain embodiments, the system of the invention 20 includes at least one interrogator 23 and multiple sensing devices 27 which are located along the length of the casing.

Figure 2:
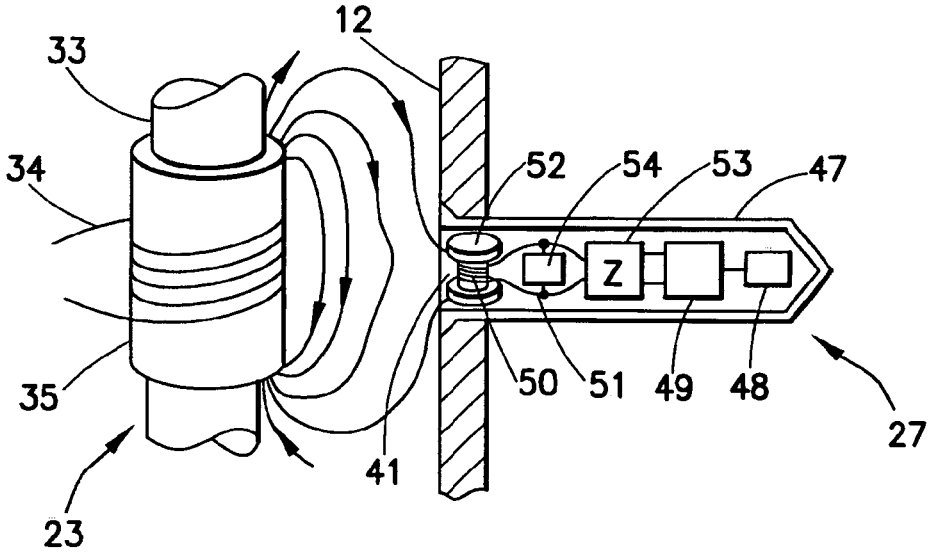
FIG. 2 is a partial cross-sectional schematic diagram showing the system of the invention and illustrating the magnetic flux generated by an interrogator during communication of information from the interrogator to a sensing device.
Figure 3:
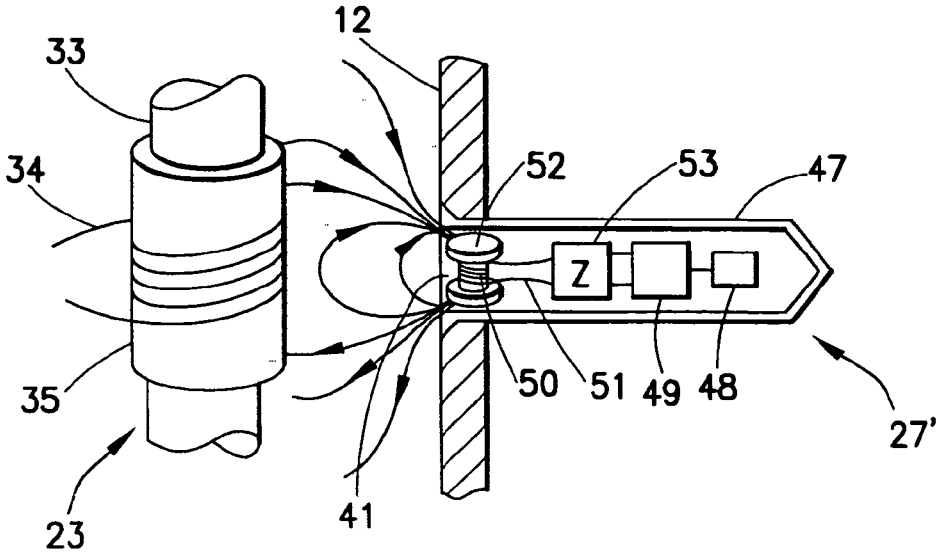
FIG. 3 is a partial schematic cross-sectional diagram showing the system of the invention and illustrating the magnetic flux generated by a sensing device during communication of information from the sensing device to an interrogator.

As seen in FIGS. 2 and 3, the interrogating device 23 includes an elongate body (rod or pipe) 33 which supports a conductive winding 34. The winding 34 is preferably oriented with its main axis aligned parallel to the borehole axis as shown. If, for reasons of mechanical strength or otherwise, the body 33 is made of conductive materials such as metals, the magnetic flux generated by the winding 34 (as described below in more detail) may cause eddy currents to flow (circulate) within the body 33. These eddy currents, which dissipate power without contributing to the operation of the present invention, are preferably reduced by adding a sleeve 35 made of a material of high magnetic permeability (such as ferrite) that is interposed between the winding 34 and the body 33 as shown. The winding 34 is preferably insulated from the body 33. The interrogating device 23 is preferably implemented as a tool conveyed via wireline, slick line, or coiled tubing. Thus, the elongate body 33 is typically between one foot and several feet long, although it may be longer or shorter if desired. Alternatively, the interrogating device 23 may be embedded in a drill pipe, drill collar, production tubing, or other permanently or temporarily installed component of a wellbore completion, as described below. Regardless, the interrogating device 23 may be adapted to communicate with surface equipment (not shown) via any of many telemetry schemes known in the art, and may use electric conductors, optical fibers, mud (column) pulsing, or other systems to accomplish the same. Alternatively, the interrogating device 23 may include data storage means such as local memory (not shown) for storing data retrieved from sensors. The content of the memory may be unloaded when the interrogator 23 is retrieved to the surface of the formation 10.

The sensing device 27 of the invention is shown positioned and fixed in an opening 41 cut in the casing 12, and includes a housing 47, one or more sensors 48 (one shown) with associated electronic circuitry 49 and a winding 50 comprising several turns of an insulated wire 51 wound around a cylindrical body 52 (such as a bobbin as shown) made of material of high magnetic permeability (such as ferrite). The sensor winding 50 is preferably positioned as flush as possible with the inner surface of the casing 12, and is oriented with its main axis aligned parallel to the borehole axis as shown. The housing 47 may be an assembly of several parts made of the same or different materials, including, but not limited to metals, ceramics, and elastomers. Depending upon the type of sensor(s) 48 included in the sensing device 27, the housing 47 may include one or more holes (not shown) which allows formation (or wellbore) fluids to come into contact with the sensor(s) 48. The sensing device 27 preferably does not extend inside the wellbore and therefore allows for unimpeded motion of equipment within the wellbore.

The sensor 48 and electronic circuitry 49 preferably perform multiple functions. In particular, each sensor 48 preferably senses one or more properties of the formation 10 surrounding the casing (e.g., pressure, temperature, resistivity, fluid constituents, fluid properties, etc.), and/or one or more properties of the casing 12 itself (e.g., inclination, mechanical stress, etc.). The sensing may be continuous, at predefined times, or only when commanded by the interrogator 23. If the sensing is continuous or at predefined times, the sensing device 27 may store information it obtains in memory (which may be part of the associated circuitry 49) until the sensing device is interrogated by the interrogator 23. When interrogated, the circuitry 49 associated with the sensor 48 preferably functions to transmit (via the sensor winding 50) information obtained by the sensor 48 to the interrogator 23 as will be described hereinafter. The sensing device 27 may, if desired, incorporate a unique code to unambiguously identify itself to the interrogator 23.

According to one aspect of the invention, the interrogator 23 either includes means for modulating current in its winding 34, or is coupled to such a modulating current generator. By modulating current in the winding 34 of the interrogator in accordance with a data signal (which is to be passed from the interrogator 23 to the sensing device 27), magnetic flux circulates in loops in the local region of the wellbore that is adjacent the interrogator 23 as depicted schematically in FIG. 2. When the interrogator 23 is positioned in this local region, the circulating magnetic flux generated by the interrogator winding 34 induces modulating current in sensor winding 50. In essence, the interrogator winding 34 and the sensor winding 50 constitute a loosely-coupled transformer. The modulating current in the sensor winding 50 induces a modulated voltage signal across a load impedance 53 coupled thereto. The electronic circuitry 49 demodulates the modulated voltage signal to recover the data signal. Note that any one of the many current modulation (and corresponding demodulation) schemes well known in the art may be used to carry information in the data signal passed from the interrogator 23 to the sensing device 27. In the preferred embodiment, the information is modulated onto a carrier signal whereby the current in the interrogator winding is forced to oscillate at a frequency on the order of 100 KHz.

According to one aspect of the invention, the current generated in the sensor winding 50 may be rectified by circuitry 49 in order to provide power to the circuitry 49 and the sensor(s) 48. If the current generated in the sensor winding 50 is too weak to power the electronic circuitry 49 and sensor(s) 48 directly, the current may be accumulated over a suitable period of time in an energy storage component such as a capacitor, a supercapacitor or a battery. The electronic circuitry 49 may wake up and become active when the accumulated charge is sufficient for its correct operation.

According to another aspect of the invention, the sensing device 27 may send information to the interrogator 23 by controlling operation of an electronic switch 54 that is connected across the sensor winding 50 as shown in FIG. 2. When the switch 54 is closed, current induced in the winding 50 circulates in an unimpeded manner; this current gives rise to a magnetic field which cancels (or greatly attenuates) the impinging magnetic field in the vicinity of the bobbin 52. This disturbance in the impinging magnetic field, which occurs in the local region of the wellbore adjacent the sensing device 27, induces small signal current modulations in the winding 34 of the interrogator 23. The current modulation in the winding 34 induces a modulated voltage signal in the interrogator 23. When the switch 54 is open, the winding 50 of the sensing device 27 does not generate the canceling magnetic field, and therefore does not induce small signal current modulations in the winding 34 of the interrogator 23 and the corresponding modulated voltage signal in the interrogator 23. Thus, by selectively activating and deactivating switch 54 in a coded sequence (as dictated by a data signal), and demodulating the voltage signal induced the small signal current modulations in the interrogator winding 34 to recover the data signal, information encoded by the data signal is passed from the sensing device 27 to the interrogator 23.

In an alternate embodiment as shown in FIG. 3, the sensing device 27' may send information to the interrogator 23 by adapting the electronic circuitry 49 to include means for injecting modulating current into the sensor winding 50. By modulating current in the sensor winding 50 in accordance with a data signal (which is to be passed from the sensing device 27 to the interrogator 23), magnetic flux circulates in loops in the local region of the wellbore that is adjacent the sensing device 27 as depicted schematically in FIG. 3. When the interrogator 23 is positioned in this local region, the circulating magnetic flux generated by the sensor winding 50 induces modulating current in interrogator winding 34. In essence, the sensor winding 50 and the interrogator winding 34 constitute a loosely-coupled transformer. The modulating current in the interrogator winding 50 induces a modulated voltage signal across a load impedance (not shown) coupled thereto. The interrogator 23 demodulates the modulated voltage signal to recover the data signal. Note that any one of the many current modulation (and corresponding demodulation) schemes well known in the art may be used to carry information in the data signal passed from the sensing device 27 to the interrogator 23. In the preferred embodiment, the information is modulated onto a carrier signal whereby the current in the sensor winding 50 is forced to oscillate at a frequency on the order of 100 KHz.

It should be appreciated by those skilled in the art that the configuration of the winding 34 and/or winding 50 as well as the relative amplitudes and phases of the currents injected into the windings can be adjusted in order to cancel (or strengthen) the magnetic field at specific locations in the wellbore. For example, the interrogator 23 may include a pair of windings that are separated along their common main axis by a small gap. In this configuration, the two windings can be driven with opposite currents (e.g., currents which flow in opposing directions around the common main axis) to create a sharp null in the telemetry's transfer function when the gap is aligned (e.g., directly faces) with the winding 50 of the sensing device 27 (or 27'). Thus, the sensing device 27 may be used as a marker for the purpose of defining or identifying a place of particular interest along the well, as the location of the sensing device can be located very accurately by moving the interrogator 23 past the sensing device 27 and noting the location of a sharp null signal followed by a phase reversal.

Figure 4:
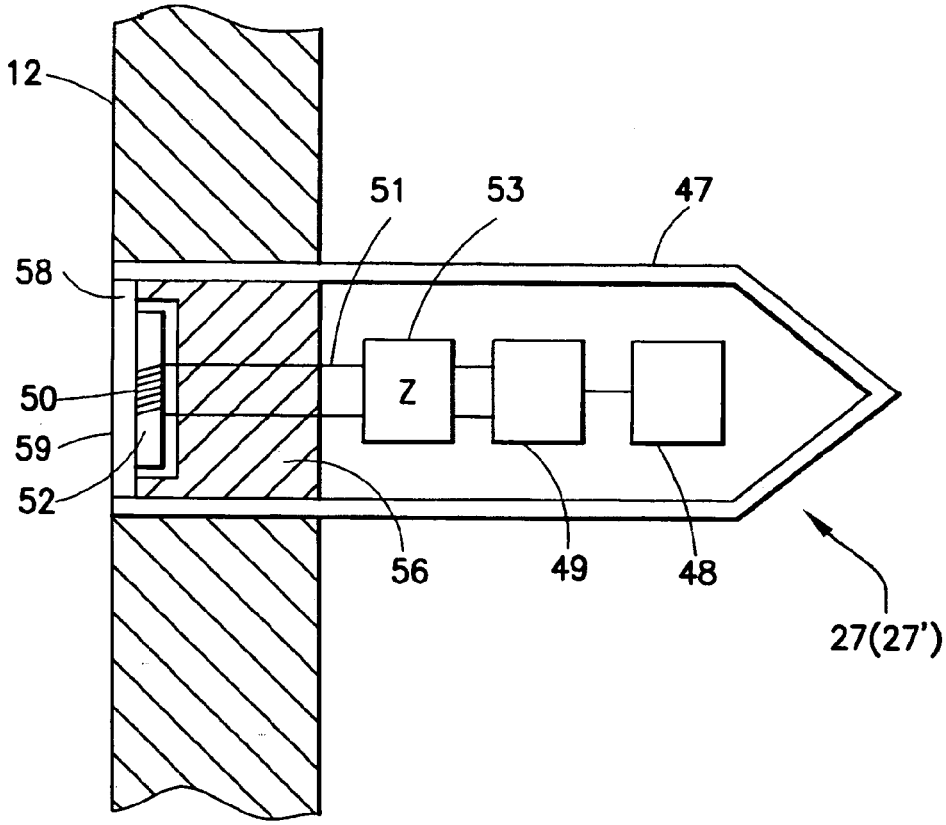
FIG. 4 is a partial cross-sectional schematic diagram showing the system of the invention and illustrating an exemplary mechanism for hydraulic isolation of wellbore fluids from the sensor(s) and associated circuitry of the sensing device (as well as hydraulic isolation of wellbore fluids from the formation).

As shown in FIG. 4, the body 52 and sensor winding 50 are preferably disposed within material 56 that provides an hydraulic seal that prevents any wellbore fluids from entering into the cavity defined by the housing 47 in which is disposed the load impedance 53 in addition to the sensor(s) 48 and associated circuitry 49 (and also prevents fluid communication between the formation and the wellbore in the event that the housing 47 is in fluid communication with the formation as described herein). In the event that the seal material 56 is conductive, the body 52 and sensor winding 50 are electrically isolated from the seal material 56 with an insulator 58 as shown. In addition, a cover 59 is preferably provided that protects the sensor winding 50 from the fluid (and other wellbore devices) disposed in the wellbore. Note that in alternate embodiments where the sensor(s) 48 are adapted to sense characteristics of the wellbore fluid, the seal material 56 may be adapted (or omitted) to provide for fluid communication between the wellbore and a cavity defined by the sensor housing 47 in which is disposed the associated sensor(s).

Figure 5:
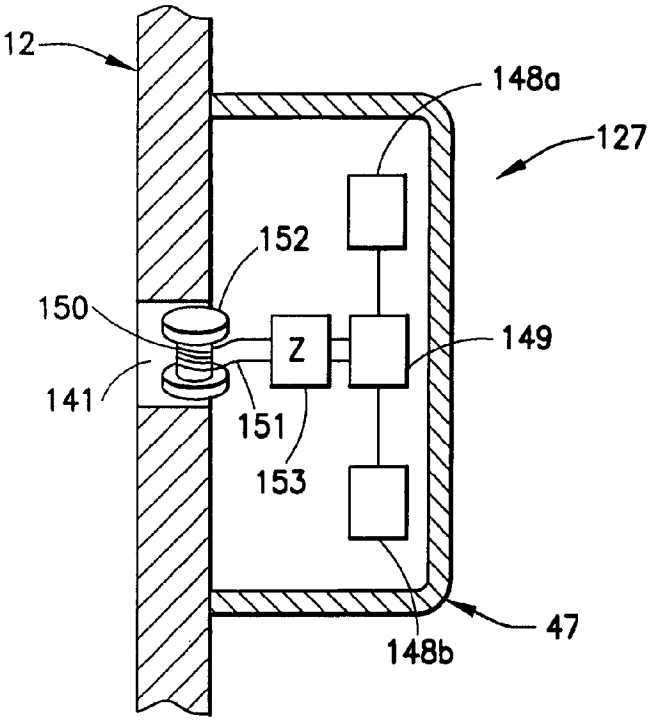
FIG. 5 is a partial schematic cross-sectional diagram showing another embodiment of a sensing device according to the invention.

Turning now to FIG. 5, a second embodiment of a sensing device 127 of the invention is shown. The sensing device 127 includes a housing 147, two sensors 148*a*, 148*b*, electronic circuitry 149, and a winding 150 comprising several turns of an insulated wire 151 wound around a cylindrical body 152 (such as a bobbin as shown) made of material of high magnetic permeability (such as ferrite). As seen in FIG. 5, the housing 147 of sensing device 127 is mounted to the outer surface of the casing 12, while the sensor winding 150 is positioned as flush as possible with the inner surface of the casing 12 and is oriented with its main axis aligned parallel to the borehole axis. With the provided geometry, it will be appreciated that the sensing device 127 is preferably attached to the casing 12 prior to the installation of the casing in the wellbore. It will also be appreciated that sensing device 127 may function in the same manner as sensing devices 27 and 27' of FIGS. 2 and 3.

The system of the invention may include a plurality of sensing devices 27 (27') or 127 and at least one interrogating device 23. The sensing device may be located along the length of the casing 12 and/or at different azimuths of the casing. The interrogating device may be moved through the wellbore.

According to one embodiment of the method of the invention, a plurality of sensing devices are located-along the length of the casing, the interrogating device is moved through the casing, the interrogating device is used to signal the sensing device, and the sensing device obtains information regarding the formation (either prior to being interrogated and/or after being interrogated) and provides that information to the interrogating device in a wireless manner.

According to another embodiment of the method of the invention, at least one sensing device is located along the length of the casing at a desired location along the wellbore, the interrogating device is moved through the casing, and a change in the wireless signal provided by the sensing device to the interrogating device is used to precisely locate the desired location along the wellbore. More particularly, by moving the interrogator past the sensing device and noting the location of a sharp null signal followed by a phase reversal the location of interest (i.e., the location where the sensing device is located) may be identified precisely.

Figure 6:
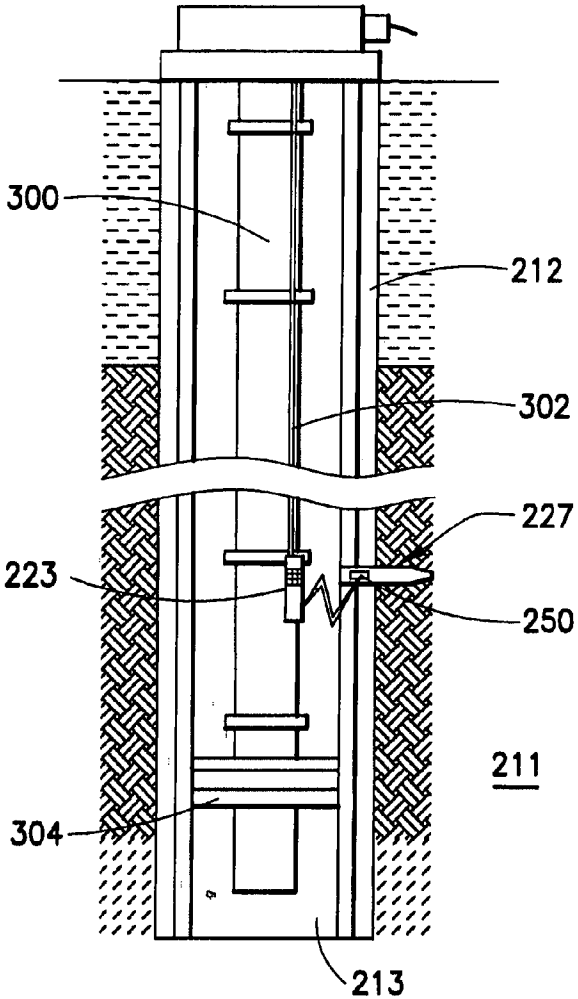
FIG. 6 is a schematic diagram showing an alternative embodiment of the system of the invention.

An alternative embodiment of the inventive apparatus is shown in FIG. 6. In FIG. 6, an earth formation 211 is traversed by a wellbore 213 having a casing 212 extending at least partially therein. An interrogating device 223 having a winding 234 is shown attached to production tubing 300. The interrogating device 223 communicates to the surface using one or more connecting cables 302 that supply power to the device and provide telemetry capability between the device and the surface, using conventional electrical or optical means. Sensing device 227 is shown positioned and fixed in an opening cut in the casing 212 and incorporates winding 250. A packer 304 is used to hydraulically isolate the areas within the casing 212 above and below the packer. In the same manner as discussed above, power and data may be exchanged between the interrogating device 223 and the sensing device 227. In contrast to other embodiments of the inventive system described above, interrogating device 223 is not readily moveable within casing 212. A significant advantage to this embodiment over a system such as that described in U.S. Pat. No. 6,378,610 to Rayssiguier et al. is that the sensing device 227 may be put in place prior to the installation of the production tubing 300 (and the attached interrogating device 223) and the system allows for power and data to be exchanged between the interrogating device 223 and the sensing device 227 without the need for a complicated and potentially failure prone downhole 'wet connect' type of connector. It will be understood by those skilled in the art that a plurality of different sensing devices 227 may be associated with a single interrogating device 223, that multiple sets of interrogating devices and sensing devices may be associated with a single completion design, that a plurality of packers 304 may be employed, particularly where multiple production zones are simultaneously completed, and that these packers may be located above or below the interrogating devices and sensing devices.

There have been described and illustrated herein embodiments of systems, methods and apparatus for obtaining formation information utilizing sensors attached to a casing in a wellbore. While particular embodiments of the invention have been described, it is not intended that the invention be limited thereto, as it is intended that the invention be as broad in scope as the art will allow and that the specification be read likewise. Thus, while the invention was described with reference to a particular interrogating device and particular sensing devices, other interrogating devices and sensing devices could be utilized. For example, the interrogating device and/or sensing device may utilize a plurality of solenoidal windings in order to provide improved magnetic coupling therebetween. Also, instead of using solenoidal windings, any other magnetic coupling mechanism may be used. Moreover, instead of utilizing the two terminals of the sensor winding as differential input to the load impedance of the sensing device, one of the terminals of the sensor winding may be grounded and the other terminal of the sensor winding used as a single-ended input to the load impedance of the sensing device. Furthermore, with respect to the sensing devices, it will be appreciated that various other types of sensing devices such as disclosed in previously incorporated U.S. Ser. No. 10/163,784 may be utilized. In addition to casings and liners, the sensing apparatus may be deployed in any type of wellbore device, such as sand screens. While preferably deployed in a wellbore device containing conductive fluid, the system can also operate in non-conductive fluid. It will therefore be appreciated by those skilled in the art that yet other modifications could be made to the provided invention without deviating from its spirit and scope as claimed.

We claim:

1. A sensing apparatus which is affixed to a wellbore device, the wellbore device located and fixed in an earth formation traversed by the wellbore device, said sensing apparatus comprising:

a) a housing disposed in an opening through the wellbore device and extending into said earth formation, said housing in contact with the wellbore device;

b) a sensor which senses a condition of at least one of the earth formation, the wellbore device, and a fluid in the wellbore device, and c) circuitry, housed within said housing and coupled to said sensor, that generates a wireless signal related to a determination of said condition sensed by said sensor, wherein said wireless signal is represented by magnetic flux in a local region of the wellbore device that is adjacent said sensing apparatus, and wherein said wireless signal is adapted to communicate information to an interrogator device that is movable in said wellbore device to a position in said local region.

2. A sensing apparatus according to claim 1, wherein:

said circuitry includes at least one solenoidal winding through which a modulating current is injected to thereby induce said magnetic flux.

3. A sensing apparatus according to claim 2, wherein:

said at least one solenoidal winding is adapted to be adjacent with a surface of the wellbore device.

4. A sensing apparatus according to claim 2, wherein:

the wellbore device has a longitudinal axis, and said at least one solenoidal winding is oriented with its main axis substantially parallel to the longitudinal axis of the wellbore device.

5. A sensing apparatus according to claim 2, wherein:

said circuitry includes an electrical switch coupled across said at least one solenoidal winding, and means for selectively activating and de-activating said electrical switch to generate said modulating current to thereby induce said magnetic flux.

6. A sensing apparatus according to claim 2, wherein:
said circuitry includes means for injecting modulating current into said at least one solenoidal winding to thereby induce said magnetic flux.

7. A sensing apparatus according to claim 2, wherein:
said circuitry injects an alternating current into said at least one solenoidal winding.

8. A sensing apparatus according to claim 2, wherein:
said at least one solenoidal winding is wound around a body of high magnetic permeability material.

9. A sensing apparatus according to claim 1, wherein:
said circuitry includes a rectifier which supplies power to said sensor.

10. A sensing apparatus according to claim 1, wherein:
said sensor senses at least one of temperature, pressure, resistivity, fluid constituents, and fluid properties of the formation.

11. A sensing apparatus according to claim 1, further comprising:
a second sensor which senses a condition of at least one of the earth formation and the wellbore device, said second sensor coupled to said circuitry.

12. A sensing apparatus according to claim 1, wherein:
said housing is adapted to be mounted to an outer surface of the wellbore device.

13. A system for obtaining information about an earth formation traversed by a wellbore device, the wellbore device fixed within the earth formation, said system including:
a) an interrogator movable in the wellbore device; and
b) at least one sensing apparatus which is affixed to the wellbore device and which extends into the formation, said at least one sensing apparatus including
i) a housing disposed in an opening through the wellbore device and extending into said earth formation, said housing in contact with the wellbore device,
ii) a sensor which senses a condition of at least one of the earth formation, the wellbore device, and fluid in the wellbore device, and
iii) circuitry, housed within said housing and coupled to said sensor, that generates a first wireless signal related to a determination of said condition sensed by said sensor, wherein said first wireless signal is represented by magnetic flux in a local region of the wellbore device that is adjacent said sensing apparatus;
wherein said interrogator is adapted to receive said fist wireless signal when moved to a position in said local region.

14. A system according to claim 13, wherein:
said interrogator comprises a conductive winding carried by an elongate body.

15. A system according to claim 14, wherein a core of high magnetic permeability material surrounds a portion of said elongate body and is interposed between said elongate body and said conductive winding.

16. A system according to claim 15, wherein:
said core is affixed to said elongate body.

17. A system according to claim 14, wherein:
said interrogator processes a modulating current signal induced in said conductive winding when receiving said first wireless signal.

18. A system according to claim 14, wherein:
said interrogator generates a second wireless signal by injecting a modulating current signal into said conductive winding to generate magnetic flux in a local region of the wellbore device that is adjacent said interrogator, and
wherein said sensing apparatus is adapted to receive said second wireless signal when said interrogator is moved in the vicinity of said sensing apparatus.

19. A system according to claim 13, wherein:
said circuitry includes at least one solenoidal winding through which a modulating current passes during wireless communication between said at least one sensing apparatus and said interrogator.

20. A system according to claim 19, wherein:
said at least one solenoidal winding is adapted to be adjacent with a surface of the wellbore device.

21. A system according to claim 19, wherein:
the wellbore device has a longitudinal axis, and said at least one solenoidal winding is oriented with its main axis substantially parallel to the longitudinal axis of the wellbore device.

22. A system according to claim 19, wherein:
said circuitry includes an electrical switch coupled across said at least one solenoidal winding, and means for selectively activating and de-activating said electrical switch to generate said modulating current.

23. A system according to claim 19, wherein:
said circuitry includes means for injecting modulating current into said at least one solenoidal winding.

24. A system according to claim 23, wherein:
said circuitry injects an alternating current into said at least one solenoidal winding.

25. A system according to claim 19, wherein:
said at least one solenoidal winding is wound around a body of high magnetic permeability material.

26. A system according to claim 19, wherein:
said circuitry includes a rectifier which supplies power to said sensor.

27. A system according to claim 13, wherein:
said sensor senses at least one of temperature, pressure, resistivity, fluid constituents, and fluid properties of the formation.

28. A system according to claim 13, wherein:
said at least one sensing apparatus comprises a plurality of substantially identical sensing apparatus spaced along the wellbore device.

29. A system according to claim 28, wherein:
said plurality of substantially identical sensing apparatus are spaced both longitudinally and azimuthally along the wellbore device.

30. A method for transmitting information in an earth formation traversed by a wellbore device, the wellbore device located and fixed in the earth formation, the method comprising:
a) affixing at least one sensing apparatus to the wellbore device such that the sensing apparatus extends into the formation, said at least one sensing apparatus including
i) a housing disposed in an opening through the wellbore device and extending into said earth formation, said housing in contact with the wellbore device,
ii) a sensor which is capable of sensing a condition of at least one of the earth formation, the wellbore device, and a fluid in the wellbore device, and
iii) circuitry, housed within said housing and coupled to said sensor, that is capable of generating a first wireless signal related to a determination of said condition sensed by said sensor, wherein said first wireless signal is represented by magnetic flux in a region of the wellbore device in a local region of the wellbore device that is adjacent said sensing apparatus;

b) sensing with said sensing apparatus the condition of at least one of the earth formation, the wellbore device, and a fluid in the wellbore device;

c) locating an interrogator device in said local region of the wellbore device that is adjacent said sensing apparatus;

d) generating the first wireless signal related to a determination of said condition sensed by said sensor;

e) receiving the first wireless signal at said interrogator device; and f) causing an indication of said first wireless signal to be obtained uphole.

31. A method according to claim 30, wherein:

said affixing comprises affixing a plurality of substantially identical sensing apparatus spaced along the wellbore device.

32. A method according to claim 31, wherein:

said plurality of substantially identical sensing apparatus are affixed both longitudinally and azimuthally along the wellbore device.

33. A method according to claim 32, wherein:

said locating comprises moving said interrogator device within the wellbore device to different locations in the vicinities of said plurality of sensing apparatus.

34. A method according to claim 30, wherein:

said locating comprises moving said interrogator device within the wellbore device.

35. A method according to claim 30, wherein:

said interrogator device comprises a conductive winding carried by an elongate body.

36. A method according to claim 35, wherein:

a core of high magnetic permeability material surrounds a portion of said elongate body and is interposed between said elongate body and said conductive winding.

37. A method according to claim 35, further comprising:

injecting a modulating current signal into said conductive winding to generate a second wireless signal in the local region of the wellbore device that is adjacent said sensing apparatus; and receiving said second wireless signal at said at least one sensing apparatus.

38. A method according to claim 37, wherein:

said second wireless signal is a wakeup signal for said sensing device.

39. A method for identifying a place of interest in an earth formation traversed by a wellbore device, the method comprising:

a) affixing a location indicator to the wellbore device at the place of interest, said at least one location indicator including a housing in contact with the wellbore device and circuitry that is capable of generating a wireless signal represented by magnetic flux in a local region of the wellbore device that is adjacent said at least one location indicator;

b) generating said wireless signal with said location indicator;

c) moving a detecting device through the wellbore device and past said location indicator, said detecting device adapted to receive said wireless signal;

d) identifying the place of interest by finding a sharp null in said wireless signal.

40. A method of interrogating a sensing apparatus which is affixed to a wellbore device, the method comprising:

a) locating an interrogator device in the vicinity of the sensing apparatus;

b) communicating a wireless signal between the sensing apparatus and said interrogator device utilizing a loosely-coupled transformer interface therebetween; and c) causing an indication of said wireless signal to be obtained uphole.

41. A sensing apparatus which is affixed to a wellbore device, the wellbore device located in an earth formation traversed by the wellbore device, said sensing apparatus comprising:

a) a housing in contact with the wellbore device;

b) a sensor which senses a condition of at least one of the earth formation, the wellbore device, and a fluid in the wellbore device, and c) circuitry, coupled to said sensor, that generates a wireless signal related to a determination of said condition sensed by said sensor, wherein said wireless signal is represented by magnetic flux in a local region of the wellbore device that is adjacent said sensing apparatus, wherein said wireless signal is adapted to communicate information to an interrogator device that is movable in said wellbore device to a position in said local region, and wherein said circuitry includes at least one solenoidal winding through which a modulating current is injected to thereby induce said magnetic flux.

42. A sensing apparatus according to claim 41, wherein:

said at least one solenoidal winding is adapted to be adjacent with a surface of the wellbore device.

43. A sensing apparatus according to claim 41, wherein:

the wellbore device has a longitudinal axis, and said at least one solenoidal winding is oriented with its main axis substantially parallel to the longitudinal axis of the wellbore device.

44. A sensing apparatus according to claim 41, wherein:

said circuitry includes an electrical switch coupled across said at least one solenoidal winding, and means for selectively activating and de-activating said electrical switch to generate said modulating current to thereby induce said magnetic flux.

45. A sensing apparatus according to claim 41, wherein:

said circuitry includes means for injecting modulating current into said at least one solenoidal winding to thereby induce said magnetic flux.

46. A sensing apparatus according to claim 41, wherein:

said circuitry injects an alternating current into said at least one solenoidal winding.

47. A sensing apparatus according to claim 41, wherein:

said at least one solenoidal winding is wound around a body of high magnetic permeability material.

48. A sensing apparatus according to claim 41, wherein:

said circuitry includes a rectifier which supplies power to said sensor.

49. A sensing apparatus according to claim 41, wherein:

said sensor senses at least one of temperature, pressure, resistivity, fluid constituents, and fluid properties of the formation.

50. A sensing apparatus according to claim 41, further comprising:

a second sensor which senses a condition of at least one of the earth formation and the wellbore device, said second sensor coupled to said circuitry.

51. A sensing apparatus according to claim 41, wherein:

said housing is adapted to be mounted to an outer surface of the wellbore device.

* * * * *